US008147239B2

(12) United States Patent
Kim

(10) Patent No.: US 8,147,239 B2
(45) Date of Patent: Apr. 3, 2012

(54) METHOD OF CONTROLLING GAS TYPE CLOTHES DRYER

(75) Inventor: Chang Hoo Kim, Incheon (KR)

(73) Assignee: Daewoo Electronics Corporation, Seoul (KR)

( * ) Notice: Subject to any disclaimer, the term of this patent is extended or adjusted under 35 U.S.C. 154(b) by 424 days.

(21) Appl. No.: 12/435,788

(22) Filed: May 5, 2009

(65) Prior Publication Data

US 2009/0280445 A1 Nov. 12, 2009

(30) Foreign Application Priority Data

May 6, 2008 (KR) ..... 10-2008-0041812

(51) Int. Cl.
*F23N 5/00* (2006.01)

(52) U.S. Cl. ..... 431/69; 431/12; 431/27; 431/46; 431/66; 431/67; 431/70; 431/71

(58) Field of Classification Search ..... 431/12, 431/24, 25, 26, 27, 46, 66, 67, 69, 70, 71
See application file for complete search history.

(56) References Cited

U.S. PATENT DOCUMENTS

| | | | | | |
|---|---|---|---|---|---|
| 3,183,959 | A * | 5/1965 | Romanelli | 431/66 |
| 3,370,838 | A * | 2/1968 | Menk | 432/57 |
| 3,806,308 | A * | 4/1974 | Cahoe et al. | 432/44 |
| 4,190,414 | A * | 2/1980 | Elmy | 432/46 |
| 4,194,875 | A * | 3/1980 | Hewitt | 431/45 |
| 4,269,589 | A * | 5/1981 | Matthews | 431/46 |
| 4,402,663 | A * | 9/1983 | Romanelli et al. | 431/66 |
| 4,429,682 | A * | 2/1984 | Huang | 431/16 |
| 4,459,097 | A * | 7/1984 | Riordan et al. | 431/25 |
| 4,806,095 | A * | 2/1989 | Goldstein et al. | 431/54 |
| 5,035,607 | A * | 7/1991 | Peterson | 431/46 |
| 5,133,656 | A * | 7/1992 | Peterson | 431/66 |
| 5,538,416 | A * | 7/1996 | Peterson et al. | 431/46 |
| 6,653,790 | B2 * | 11/2003 | Willamor et al. | 315/91 |
| 2003/0178944 | A1 * | 9/2003 | Willamor et al. | 315/91 |
| 2004/0209209 | A1 * | 10/2004 | Chodacki et al. | 431/66 |
| 2007/0068511 | A1 * | 3/2007 | Bachinsky et al. | 126/503 |

* cited by examiner

*Primary Examiner* — Kenneth Rinehart
*Assistant Examiner* — Jorge Pereiro
(74) *Attorney, Agent, or Firm* — Occhiuti Rohlicek & Tsao LLP

(57) ABSTRACT

Disclosed herein is a method of controlling a gas type clothes dryer. The method control the dryer to continuously detect condition of a flame sensor even after ignition of the dryer, thereby preventing a drying operation from being performed when a flame has been extinguished due to insufficient gas supply caused by failure of a gas valve.

12 Claims, 3 Drawing Sheets

METHOD OF CONTROLLING GAS TYPE CLOTHES DRYER

CROSS-REFERENCE TO RELATED APPLICATIONS

The present application claims priority to Korean patent application number 10-2008-0041812, filed on May 6, 2008, which is incorporated by reference in its entirety.

BACKGROUND OF THE INVENTION

1. Field of the Invention

The present invention relates to a method of controlling a gas type clothes dryer. More particularly, the present invention relates to a method of controlling a gas type clothes dryer that continuously detects condition of a flame sensor even after ignition of the dryer, thereby preventing a drying operation from being performed when a flame has been extinguished due to insufficient gas supply caused by failure of a gas valve.

2. Description of the Related Art

FIG. 1 is an exploded perspective view of main parts of a general gas type clothes dryer.

Referring to FIG. 1, the clothes dryer has a drum 1 inside a cabinet (not shown) that constitutes an outer appearance of the dryer.

The drum 1 has a cylindrical shape and is open at both sides. A belt groove 2 is formed along the middle of an outer peripheral surface of the drum 1 such that a belt (not shown) is wound around the belt groove 2 and driven by a separate drive source, and a drying chamber 5 for a drying operation is defined in the drum 1.

The drying chamber 5 has a plurality of baffles 6 formed on an inner surface thereof to tumble laundry received in the drying chamber 5 during rotation of the drum 1.

A front head 7 and a rear head 9 are provided to front and rear ends of the drum 1, respectively. The front and read heads 7 and 9 close the openings of the drum 1 to define the drying chamber 5 while supporting the front and rear ends of the drum 1.

Further, sealing members 10 are interposed between the front head 7 and the drum 1 and between the rear head 9 and the drum 1 to prevent leakage.

The dryer is provided with a plurality of rollers (not shown) at locations corresponding to the front and rear ends of the drum 1 to support the drum 1.

The front head 7 is formed with a through-hole 8 through which the interior of the drying chamber 5 communicates with the outside. The through-hole 8 is selectively opened/closed by a door (not shown).

The rear head 9 is provided with an air supply duct 12 that serves as a passage for supplying air, more specifically, hot air into the drying chamber 5 and communicates with the interior of the drying chamber 5.

One side of the front head 7 is provided with an outlet assembly 13 through which air is discharged from the drying chamber 5.

A lint filter 14 is provided to the outlet assembly 13. The lint filter 14 serves to separate foreign matter, such as lint or dust, from air discharged from the drying chamber 5 through the outlet assembly 13.

A lint duct 15 is provided to communicate with the outlet assembly 13 and receive part of the lint filter 14. A blower 17 is connected to the lint duct 15 and suctions air from the drying chamber 5 through the lint duct 15.

The blower 17 is disposed inside a blower housing 18. The blower housing 18 communicates with the lint duct 15 through one side thereof and is connected at the other side to a discharge pipe 19. Therefore, air discharged from the drying chamber 5 passes through the lint duct 15 and is discharged to the outside through the discharge pipe 19 by force from the blower 17.

On the other hand, the air supply duct 12 is connected to a hot air duct 20. The hot air duct 20 serves to supply hot air for drying operation into the drying chamber 5. For this purpose, the hot air duct 20 is provided with a component which generates thermal energy for heating air.

In other words, an inlet of the hot air duct 20 is provided with a gas nozzle 22. The gas nozzle 22 serves to spray a supplied gas. The gas nozzle 22 is provided with a gas valve which controls supply of the gas. Reference numeral 23 indicates a gas pipe.

A mixing pipe 24 extends from the inlet of the hot air duct 20 and is disposed inside the hot air duct 20 to mix primary air and the gas sprayed from the gas nozzle 22. Here, an inlet of the mixing pipe 24 is located corresponding to the gas nozzle 22.

Inside the mixing pipe 24, the gas sprayed from the gas nozzle 22 is mixed with external air introduced through the inlet of the mixing pipe 24, that is, with the primary air. The mixing pipe 24 is provided at a leading end with an ignition device 26 to generate flame for ignition.

Next, a configuration for controlling the dryer with the above configuration will be described. FIG. 2 is a block diagram of the general gas type clothes dryer.

The general gas type clothes dryer performs drying operation under control of a microcomputer 140. In the dryer, a drive unit is electrically controlled by the microcomputer 140, and sensors for detecting electrical signals output detected signals to or receive signals from the microcomputer 140.

First, a power supply signal, drying operation signal, a drying condition input signal, and the like are input to the microcomputer 140 through a key input unit 100 according to a user's selection, and a dried degree of laundry is detected and sent to the microcomputer 140 by a humidity sensor 110.

Additionally, the temperature of hot air discharged from the drum is detected and sent to the microcomputer 140 by a temperature sensor 120. Further, a door detection unit 130 sends a detection signal to the microcomputer 140 to prevent the door from being open during the drying operation.

Under control of the microcomputer 140, a drum motor drive unit 150 operates a drum motor which generates a drive force for rotating the drum 1, and a blower motor drive unit 160 operates a blower motor which generates a drive force for rotating the blower 17, so that the rotation of the drum 1 and the blower 17 can be controlled.

Further, a heater drive unit 170 operates the heater which supplies a heat source under control of the microcomputer 140.

Next, operation of the general gas type clothes dryer will be described.

When an operation button of the key input unit 100 is pressed with laundry put into the drying chamber 5 in the drum 1 and the door closed, the microcomputer 140 operates the drum motor drive unit 150 in response to an instruction for the drying operation. Then, the belt wound around the belt groove 2 is driven by a separate drive source to rotate the drum 1.

Further, the microcomputer 140 sends a control signal to the blower motor drive unit 160 to operate the blower motor. Then, the blower 17 is operated to suction air from the drying chamber 5 through the lint duct 15. As a result, external air is introduced into the drying chamber 5 through the air supply duct 12.

On the other hand, the microcomputer 140 controls the heater drive unit 170 to operate the heater such that the temperature of air supplied into the air supply duct 12 is comparatively increased to a high temperature when passing through the hot air duct 20.

Further, the microcomputer 140 operates the gas valve 28 to control gas supply through the gas nozzle 22, and controls an igniting operation and an ignition state through the ignition device 26 and the flame sensor 30.

After initial ignition by the ignition device 26, a gas is sprayed into the mixing pipe 24 by the gas nozzle 22 to continue combustion of the gas. Then, heat energy by the combustion of the gas heats the air, which has been introduced into the hot air duct 20, thereby generating hot air.

The hot air is supplied into the drying chamber 5 of the drum 1 through the air supply duct 12. The hot air absorbs moisture from the laundry within the drying chamber 5 and is discharged from the drying chamber 5 through the outlet assembly 13.

Here, the hot air is discharged from the drying chamber 5 through the outlet assembly 13 by the suction force of the blower 17. Further, foreign matter such as dust or lint is removed from the air passing through the outlet assembly 13 by the lint filter 14.

When the laundry is dried inside the drum 1 by such a hot air circulation manner, the microcomputer 140 determines a dried degree of the laundry based on a detection value of the humidity sensor 110. Further, the microcomputer 140 makes a final determination as to the dried degree of the laundry based on the temperature of the hot air, which is discharged outside the drum 1 and detected by the temperature sensor 120, and controls the drying operation based on the determination result.

It should be noted that the aforementioned technique is related to the background art of the invention and is not a conventional technique.

In order to operate such a gas type clothes dryer which uses combustion heat of a gas, it is determined whether the ignition device is normally operated by checking the condition of the flame sensor after operation of the ignition device. If it is determined that the ignition device is normally operated, the operation of the ignition device is stopped and the gas valve is operated to supply the gas, which is combusted to generate the combustion heat for drying laundry.

In such a gas type clothes dryer, although the condition of the flame sensor is initially checked to determine whether the ignition device is normally operated, the condition of the flame sensor is not checked after it is determined that the ignition device is normally operated. As a result, even in the case where the gas is not supplied due to failure of the gas valve, it is determined that the ignition device is normally operated, so that a subsequent cycle can be performed without gas supply.

SUMMARY OF THE INVENTION

The present invention is conceived to solve the problem as described above, and an aspect of the present invention is to provide a gas type clothes dryer that continuously detects condition of a flame sensor even after ignition of the dryer, thereby preventing a drying operation from being carried out when a flame has been extinguished due to insufficient gas supply caused by failure of a gas valve.

In accordance with one aspect of the present invention, a method of controlling a gas type clothes dryer includes: opening a gas valve after ignition; determining whether the gas valve is in an error state by detecting whether a flame has been extinguished after opening the gas valve; progressing a drying cycle while maintaining an open state of the gas valve according to a determination result as to the error state of the gas valve; and continuously determining whether the gas valve is in the error state during the drying cycle.

The gas valve is determined as being in the error state when it is determined that that a condition of a flame sensor still indicates a flame extinguished state even after repeating a series of procedures of closing the gas valve, performing the ignition, and opening the gas valve a predetermined number of times based on a determination that the condition of the flame sensor indicates the flame extinguished state.

If it is determined that the gas valve is in the error state, the error state of the gas valve may be displayed and operation of the dryer may be ended.

The predetermined number of times may be five times.

The opening the gas valve may include sequentially opening a primary gas valve and a secondary gas valve.

The primary gas valve and the secondary gas valve may be opened at a time interval of 2 seconds.

The closing the gas valve may include simultaneously closing the primary gas valve and the secondary gas valve.

The condition of the flame sensor may be determined within 30 seconds.

In accordance with another aspect of the present invention, a method of controlling a gas type clothes dryer, comprising: (a) operating a drum and an ignition device according to an operation signal; (b) determining a condition of a flame sensor after operating the ignition device; (c) opening a gas valve after stopping operation of the ignition device if it is determined that the condition of the flame sensor indicates an ignition state; (d) determining the condition of the flame sensor with the gas valve opened; (e) operating the ignition device with the gas valve closed, and returning back to step (b) a predetermined number of times, if it is determined that the condition of the flame sensor indicates a flame extinguished state in step (d); (f) displaying an error of the gas valve and terminating operation of the dryer if the predetermined number of times is exceeded; (g) progressing a drying cycle if it is determined that the condition of the flame sensor indicates the ignition state in step (d); and (h) continuously determining whether the gas valve is in an error state during the drying cycle.

The opening the gas valve may include sequentially opening a primary gas valve and a secondary gas valve.

The primary gas valve and the secondary gas valve may be opened at a time interval of 2 seconds.

The closing the gas valve may include simultaneously closing the primary gas valve and the secondary gas valve.

The condition of the flame sensor may be determined within 30 seconds.

The predetermined number of times may be five times.

BRIEF DESCRIPTION OF THE DRAWINGS

The above and other aspects, features and advantages of the present invention will become apparent from the following detailed description in conjunction with the accompanying drawings, in which.

DETAILED DESCRIPTION OF THE EMBODIMENT

Hereinafter, exemplary embodiments of the present invention will be described in detail with reference to the accompanying drawings. It should be noted that the drawings are not to precise scale and may be exaggerated in thickness of lines or size of components for descriptive convenience and clarity. Furthermore, the terms as used herein are defined by taking functions of the present invention into account and can be changed according to the custom or intention of users or operators. Therefore, definition of the terms should be made according to the overall disclosures set forth herein.

Figure 1:
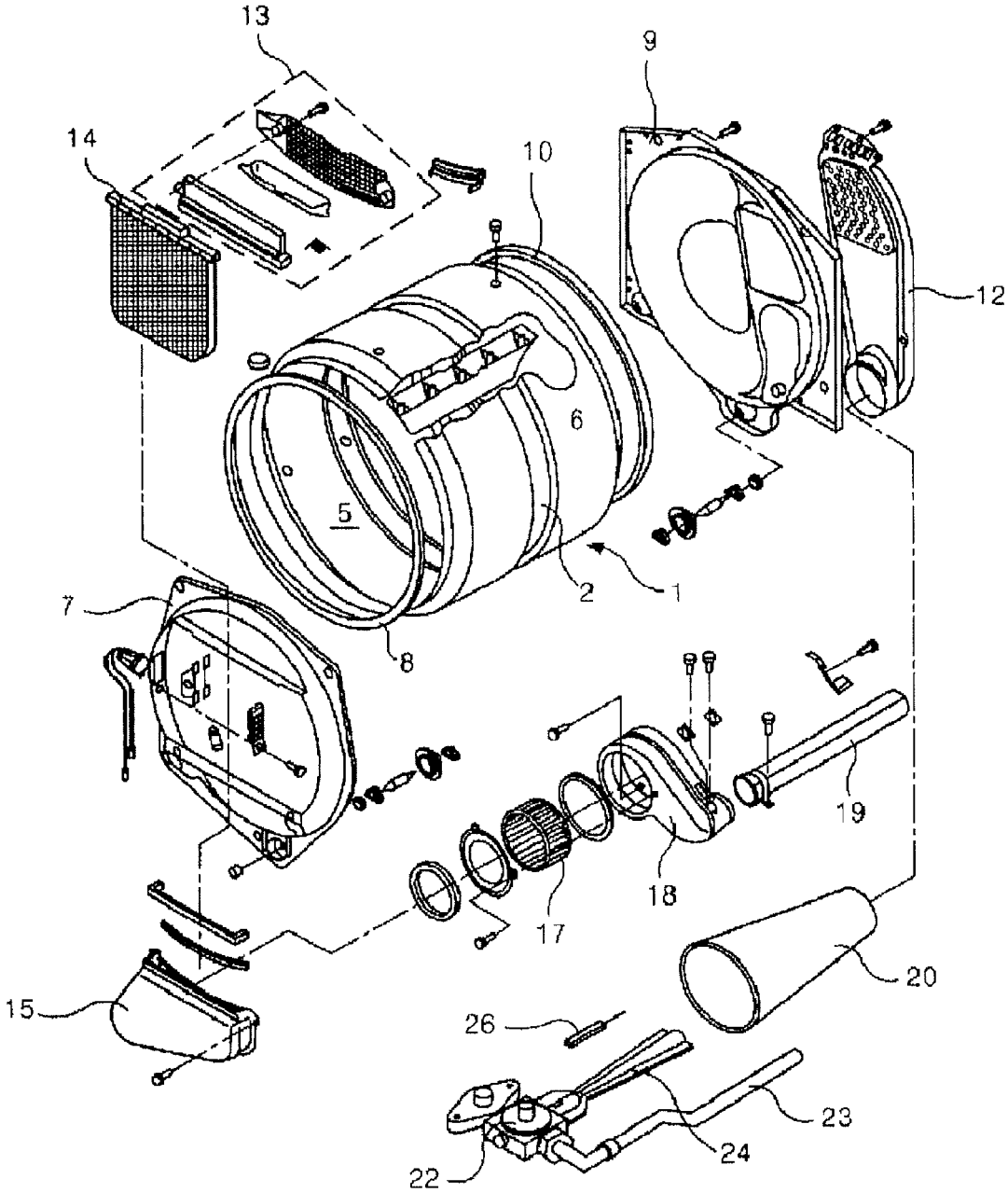
FIG. 1 PRIOR ART
FIG. 1 is an exploded perspective view of main parts of a general gas type clothes dryer.
Figure 2:
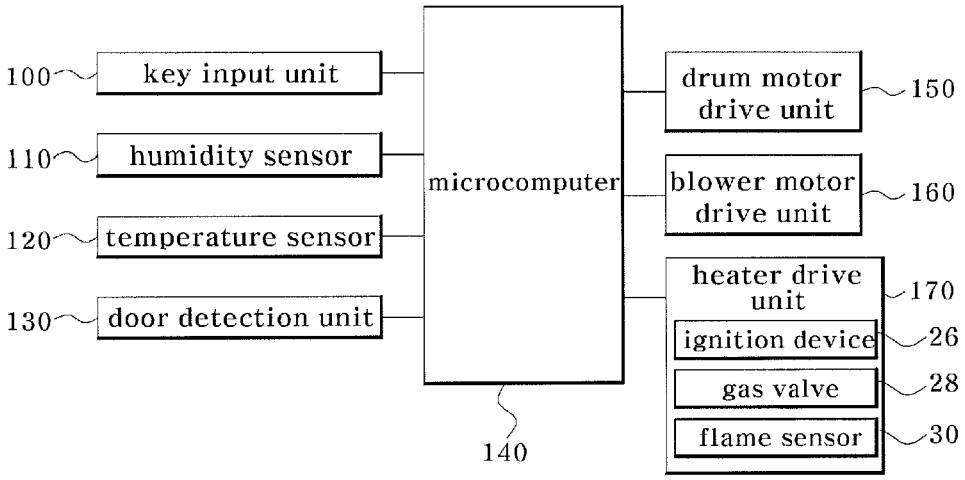
FIG. 2 PRIOR ART
FIG. 2 is a block diagram of the general gas type clothes dryer.
Figure 3:
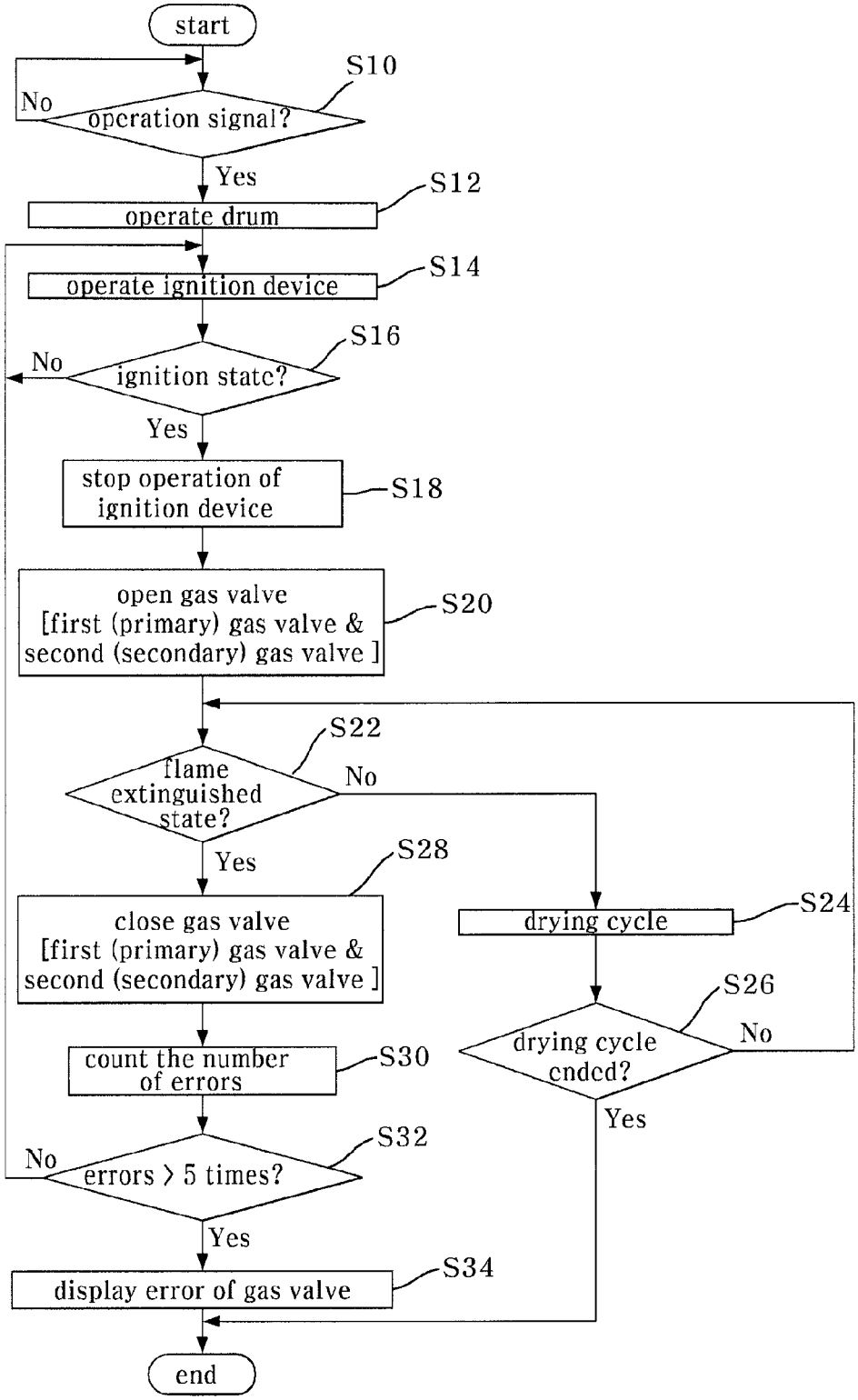
FIG. 3 is a flowchart of a method of controlling a gas type clothes dryer according to one embodiment of the present invention.

FIG. 3 is a flow chart of a method of controlling a gas type clothes dryer according to one embodiment of the present invention.

With laundry put into the drying chamber 5 in a drum 1 and a door closed, an operation button of a key input unit 100 is pressed to input an operation signal in S10, and a microcomputer 140 operates a drum 1 and enables an ignition operation in response to the operation signal in S12.

For the ignition operation, if it is determined that a condition of a flame sensor 30 indicates a flame extinguished state, an ignition device 26 is operated in S14, and the condition of the flame sensor 30 is determined again in S16.

That is, it is determined whether the condition of the flame sensor 30 indicates an ignition state.

Here, the condition of the flame sensor 30 may be determined within 30 seconds, considering that time for the ignition device 26 to reach maximum temperature is typically 15~30 seconds.

If it is determined that the condition of the flame sensor 30 indicates the ignition state, the operation of the ignition sensor 26 is stopped in S18, and the gas valve 28 is opened in S20.

The gas valve 28 comprises a first valve and a second valve. When opening the gas valve 28, the first and second valves are sequentially opened at a time interval of 2 seconds.

After opening the gas valve 28, the condition of the flame sensor 30 is determined in S22. If it is determined that the condition of the flame sensor 30 indicates the ignition state, a drying cycle is performed using combustion heat of a gas while maintaining an open state of the gas valve as a normal state, in S24.

Then, the condition of the flame sensor 30 is continuously determined until the drying cycle is completed, in S26.

However, if it is determined that the condition of the flame sensor 30 indicates the flame extinguished state, the gas valve 28 is closed in S28, and the number of errors is counted in S30.

When closing the gas valve 28, the first and second gas valves are simultaneously closed.

Then, the ignition operation is performed again, and the procedure of opening the gas valve 28 to the procedure of determining the condition of the flame sensor 30 are repeated a predetermined number of times (S14~S32).

If it is determined that the condition of the flame sensor 30 indicates the ignition state in S22 after the gas valve 28 is opened, the repetition of the procedures is stopped and the drying cycle is progressed using the combustion heat of the gas while maintaining the open state of the gas valve 28, in S24.

However, if it determined that the condition of the flame sensor 30 indicates the flame extinguished state even after repeating the procedures five times, it is determined that the gas is not supplied due to failure of the gas valve 28, and the failure of the gas valve 28 is displayed and the operation of the dryer is ended, in S32 and in S34.

In this manner, by continuously monitoring the condition of the flame sensor 30 even after the ignition is performed, the failure of the gas valve 28 is displayed in the case where combustion of the gas is not carried out insufficient gas supply caused by the failure of the gas valve 28, so that malfunction of the dryer relating to the failure of the gas valve 28 can be easily detected.

As apparent from the above description, according to one embodiment of the present invention, condition of a flame sensor is continuously detected even after ignition of the dryer, so that the dryer can prevent a drying cycle from being carried out when a flame has been extinguished due to insufficient gas supply caused by failure of a gas valve, thereby enhancing reliability of products while preventing power loss.

Although some embodiment have been provided to illustrate the present invention in conjunction with the drawings, it will be apparent to those skilled in the art that the embodiments are given by way of illustration only, and that various modifications and equivalent embodiments can be made without departing from the spirit and scope of the present invention. Accordingly, the scope of the present invention should be limited only by the accompanying claims.

What is claimed is:

1. A method of controlling a gas type clothes dryer, comprising:

operating an ignition device according to an operation signal;

opening a gas valve after stopping operation of the ignition device;

determining whether the gas valve is in an error state by detecting whether a flame has been extinguished after opening the gas valve;

progressing a drying cycle while maintaining an open state of the gas valve according to a determination result as to the error state of the gas valve; and continuously determining whether the gas valve is in the error state during the drying cycle, wherein the gas valve is determined as being in the error state when it is determined that a condition of a flame sensor still indicates a flame extinguished state even after repeating a series of procedures of closing the gas valve, performing the ignition, and opening the gas valve a predetermined number of times based on a determination that the condition of the flame sensor indicates the flame extinguished state, and wherein the closing the gas valve comprises simultaneously closing a primary gas valve and a secondary gas valve.

2. The method according to claim 1, wherein, if it is determined that the gas valve is in the error state, the error state of the gas valve is displayed and operation of the dryer is ended.

3. The method according to claim 1, wherein the predetermined number of times is five times.

4. The method according to claim 1, wherein the opening the gas valve comprises sequentially opening a primary gas valve and a secondary gas valve.

5. The method according to claim 4, wherein the primary gas valve and the secondary gas valve are opened at a time interval of 2 seconds.

6. The method according to claim 1, wherein the condition of the flame sensor is determined within 30 seconds.

7. A method of controlling a gas type clothes dryer, comprising:

(a) operating a drum and an ignition device according to an operation signal;

(b) determining a condition of a flame sensor after operating the ignition device;

(c) opening a gas valve after stopping operation of the ignition device if it is determined that the condition of the flame sensor indicates an ignition state;

(d) determining the condition of the flame sensor with the gas valve opened;

(e) operating the ignition device with the gas valve closed, and retuning back to step (b) a predetermined number of times, if it is determined that the condition of the flame sensor indicates a flame extinguished state in step (d);

(f) displaying an error of the gas valve and terminating operation of the dryer if the predetermined number of times is exceeded;

(g) progressing a drying cycle if it is determined that the condition of the flame sensor indicates the ignition state in step (d); and (h) continuously determining whether the gas valve is in an error state during the drying cycle.

8. The method according to claim 7, wherein the opening the gas valve comprises sequentially opening a primary gas valve and a secondary gas valve.

9. The method according to claim 8, wherein the primary gas valve and the secondary gas valve are opened at a time interval of 2 seconds.

10. The method according to claim 7, wherein the closing the gas valve comprises simultaneously closing a primary gas valve and a secondary gas valve.

11. The method according to claim 7, wherein the condition of the flame sensor is determined within 30 seconds.

12. The method according to claim 7, wherein the predetermined number of times is five times.

* * * * *